US007058989B2

(12) United States Patent
Domingos

(10) Patent No.: US 7,058,989 B2
(45) Date of Patent: Jun. 13, 2006

(54) SPORTS HEADBAND TO REDUCE OR PREVENT HEAD INJURY

(76) Inventor: Victor L. Domingos, 404 N. Fifth St., Harrison, NJ (US) 07029

( * ) Notice: Subject to any disclaimer, the term of this patent is extended or adjusted under 35 U.S.C. 154(b) by 42 days.

(21) Appl. No.: 10/848,232

(22) Filed: May 17, 2004

(65) Prior Publication Data

US 2005/0251898 A1 Nov. 17, 2005

(51) Int. Cl.
*A42B 3/00* (2006.01)

(52) U.S. Cl. ..... 2/412; 2/425; 2/DIG. 11

(58) Field of Classification Search ..... 2/209.3, 2/DIG. 11, 411, 412, 414, 181, 171, 909, 2/425

See application file for complete search history.

(56) References Cited

U.S. PATENT DOCUMENTS 4,619,055 A * 10/1986 Davidson ..... 36/28
4,646,367 A * 3/1987 El Hassen ..... 2/411
4,698,852 A 10/1987 Romero
4,856,116 A 8/1989 Sullivan
4,910,804 A * 3/1990 Lidgren ..... 2/209.3
5,337,420 A * 8/1994 Haysom et al. ..... 2/410
5,882,205 A 3/1999 Peterson
5,930,841 A 8/1999 Lampe et al.
5,946,734 A 9/1999 Vogan
5,963,989 A 10/1999 Robertson
6,000,062 A 12/1999 Trakh
6,247,181 B1 6/2001 Hirsch et al.
6,266,826 B1 7/2001 Alfano
6,266,827 B1 7/2001 Lampe et al.
6,339,849 B1 1/2002 Nelson et al.
6,349,416 B1 2/2002 Lampe et al.
6,374,422 B1 4/2002 Gonzalez et al.
6,389,607 B1 5/2002 Wood
6,389,608 B1 5/2002 Williams
6,397,399 B1 6/2002 Lampe et al.
6,438,761 B1 8/2002 McGarrity
6,564,390 B1 5/2003 Vernon
6,565,461 B1 5/2003 Zatlin
6,675,395 B1 1/2004 Abraham
6,880,269 B1 * 4/2005 Falone et al. ..... 36/44
2002/0069452 A1 * 6/2002 Knappl ..... 2/411

FOREIGN PATENT DOCUMENTS

GB 2318500 A * 4/1998

* cited by examiner

*Primary Examiner*—Rodney Lindsey
(74) *Attorney, Agent, or Firm*—Lowenstein Sandler PC

(57) ABSTRACT

An adjustable or custom-sized improved headband of uniform vertical height and thickness along its entire length that reduces the force of impact on the player's head and provides the player with better control in redirecting the ball.

5 Claims, 2 Drawing Sheets

SPORTS HEADBAND TO REDUCE OR PREVENT HEAD INJURY

FIELD OF THE INVENTION

The present invention relates to an improved headband that reduces the force of impact when a soccer player heads the ball and provides a player better control when deflecting the ball down toward the feet or to another player for a pass.

BACKGROUND OF THE INVENTION

Soccer is the most popular sport in the world. According to a 1997 report (Alicia McGrath and Joan Ozanne-Smith, "Heading Injuries Out Of Soccer: A Review Of The Literature," Monash Univ. Accident Research Centre, Report No. 125, November 1997 at 25), 4–22% of adults and 9–26% of youths playing soccer experience head, spine and trunk injuries. Soccer players most commonly sustain head injuries when a forcefully kicked ball strikes the head, and as a result of head to head contact, which most often occurs when two players attempt to head the ball simultaneously. Id.

Using the head to direct the ball, which is called "heading the ball," is a common feature in a soccer game. Most commonly, the forehead is used to head the ball although soccer rules provide that any part of the head may be legally used to strike the ball. The technique of heading the ball is a learned skill that requires practice to master. Id. At 27. Unfortunately, and particularly in children, learing this skill involves several head/ball impacts which may occur using improper technique.

Each time a player heads the ball, he or she in effect, has caused a minor traumatic event to the head. There is a cumulative effect of repeated minor head trauma, which can result in permanent brain damage. Id. At 27. Because young people's brains are still developing, they may be more at risk for serious injury from concussions than adults. "Is Soccer Bad for Children's Heads?: Summary of the IOM Workshop on Neuropsychological Consequences of Head Impact in Youth Soccer," Nat'l Acad. Press (2002). Concussion, a common head injury that may occur due to head impacts, is a trauma-induced change in mental status, with confusion and amnesia, and with or without a brief loss of consciousness. A concussion occurs when the head hits or is hit by an object, or when the brain is jarred against the skull, with sufficient force to cause temporary loss of function in the higher centers of the brain. The injured person may remain conscious or lose consciousness briefly, and is disoriented for some minutes after the blow.

Experts have recognized that appropriate headgear would be useful to reduce the force of impact so that mild head injuries could be minimized. Such headgear would need to take into consideration not only shock absorption characteristics, but also appearance and heat dispersion, which are important for voluntary acceptance and use. There has been considerable resistance to wearing protective headgear since the perception is that they prohibit accurate ball placement and dampen the rebound speed of the ball.

Several types of protective headgear have been developed to protect the player's head from injury while heading the ball. These devices use soft padding, a combination of soft padding and rigid plastic, For example, U.S. Pat. No. 4,698,852, which issued Oct. 13, 1987 to Romero, describes a head guard for a soccer player which has a contact portion composed of three layers. A smooth inner layer of material contacts the forehead of a soccer player and absorbs perspiration. An outer, perspiration-resistant layer of material made of suede effectively grips and halts the rotation of a soccer ball and transmits the rotational force of the ball to the intermediate layer. The intermediate layer is made of a resilient material, such as foam. The lateral displacement of the intermediate layer on contact of the headguard by the soccer ball dissipates the rotational force of the ball and facilitates a soccer player's control of the ball. The contact portion is maintained in a desired position on the forward portion of a soccer player's head by means attachable to the contact portion comprising a pair of straps adjustably interconnected by loop and hook material, i.e., velcro. The means can comprise a continuous elastic band to maintain the contact portion in a desired position on the forehead of a soccer player.

U.S. Pat. No. 5,882,205, which issued Mar. 16, 1999 to Peterson, describes a training device for teaching a soccer player the correct location to head a soccer ball which includes multiple layers of individual, removal pads concealed from view within a pocket within a cap member having a shell for conforming with a player's head.

U.S. Pat. No. 5,946,734, which issued Sep. 7, 1999 to Vogan, describes a head protector comprising an elongated member of flexible material, a protector, and an additional outer fabric layer. The elongated member may be in the form of an endless headband, a strip with opposite mating ends, or may be formed of two separate pieces. In several of the disclosed embodiments, the cushioning layer of the protector comprises pressurized, fluid-filled cells of various configurations as a cushioning layer. one embodiment, it comprises a honeycomb matrix of pressurized, fluid filled compartments having a rupturable common wall with empty compartments; according to a second embodiment, a plurality of generally uniformly sized, spaced apart, closed, fluid (preferably) air cells is formed of flexible plastic material. The protector may utilize a greater number of layers or total thickness in the portion of the protector adapted to protect the back of the head than used in the portion of the protector adapted to protect the front and sides of the head since blows to the front and sides of the head are typically cushioned, at least in part, by other parts of the body prior to impact of the head. The outer layer may be formed of a firm but flexible load spreading shell, such as a closed cell, cross-linked polyurethane or other similar resin that will also minimize the potential to cause injury to other players.

U.S. Pat. No. 5,963,989, which issued Oct. 12, 1999 to Robertson, describes a headband, which includes a padded portion adapted to ride on that area of the head normally used to head a soccer ball and an outer enclosure extending around the end to the rear where the ends are provided with fastening means. The headband can also be in the form of a closed, expandable elastic band. While a structurally homogeneous resilient pad may be used, the preferred padded portion material is based on the cushioning material of U.S. Pat. No. 5,172,494, which includes primary shock absorbing means comprising intersecting and interconnecting first and second ribs, and a secondary shock absorbing means comprising intersecting and interconnecting third and fourth ribs. The pad can be flat or curved to generally conform to the curvature of the head. It is preferably thicker at its top to provide more thickness of padding in proximity to the junction of the forehead and scalp. The resilient pad may be provided with airholes to permit the flow of cooling air and the escape of moisture.

U.S. Pat. No. 6,000,062, which issued Dec. 14, 1999 to Trakh, describes a headband comprising a band of impact-cushioning material formed of 15% "Spandex" and 85% nylon, impregnated with neoprene and formed with ends, and means attaching the ends of the band for placement about a person's head. The side portions of the head band taper downward to provide merely an attaching strap adjacent the ends. The lateral dimension of the frontal area of the headband is sufficient to cover a person's entire forehead. The headband may be worn alone or inside a conventional soccer helmet.

U.S. Pat. No. 6,349,416, which issued Feb. 26, 2002 to Lampe, describes protective headguard to be worn by an athlete having (i) a protective central pad, (ii) a rear pad, (iii) an adjustable strap system interconnecting the rear pad and the central pad, and (iv) one or more of (a) a lack of any protective padding which would cover the side of the athlete's head when the headguard is worn, (b) a channel defined by the central pad extending substantially horizontally above the athlete's brow ridges and below the athlete's frontal bone when the headguard is worn, (c) a slot in the rear pad extending substantially vertically from the athlete's occipital bone and accommodating passage of a ponytail when the headguard is worn, (d) a single unitary liner, (e) bands encircling the central pad and releasably securing a liner to the central pad, (f) a removable sleeve, (g) a spine pad extending from the front panel to the rear pad (h) perceptible lines of demarcation on the exterior surface of the central pad.

U.S. Pat. No. 6,438,761, which issued Aug. 27, 2002 to McGarrity describes an improved headguard to be worn by soccer players that protects the forehead during the act of heading the ball, which comprises an adjustable head band housing a custom molded polymeric insert as a head plate. The insert, which is commercially available under the trademark ORTHOPLAST® (Johnson & Johnson) is cut to match the oval shape of a pocket on the inner surface of the headband.

U.S. Pat. No. 6,565,461, which issued May 20, 2003 to Zatlin, describes a head protecting apparatus comprising a protecting body, at least one cushioning member and a friction member. The protective body is preferably constructed as a laminate comprised of several layers of material: a first foam body (formed from polyurethane foam having a thickness of about 0.2"), a second foam body (formed from ethylene vinyl acetate (EVA) having a thickness of about 0.2"), a generally rigid guarding member (formed from PVC having a thickness of about 0.03"), an indicia bearing member, located between the friction member and the guarding member, and a friction member. The protective body, which is adapted to be worn on a soccer player's head, includes an interior portion adapted to fit against the player's head and an exterior portion adapted for impact with the soccer ball. The friction member is on the exterior portion of the protective body and has an impact surface adapted for impact with the soccer ball. The cushioning member is positioned between the guarding member and the player's head. The protective body is configured so that the first foam body, second foam body, guarding member, and friction member lie over the player's forehead, preferably over the player's frontal bone. The head-circumscribing members include fastening members at their distal ends for fastening the distal ends of the head-circumscribing members to one another to secure the protective body to the head.

U.S. Pat. No. 6,675,395, which issued Jan. 13, 2004 to Abraham, describes a protective device comprising a horizontal sweatband portion, which includes apertures for insertion of protective material such as foam padding or a semi-rigid insert, within a generally tubular perspiration-absorbing fabric. Ends of the tubular band are joined with one another via fastener means or permanently affixed. The sweatband functions to effectively absorb perspiration and provides an appropriate level of ventilation and breathing, reducing heat in the process. The sweatband is also expandable, much in the manner of a traditional headband. In an enhanced mode, the horizontal sweatband may be affixed to a vertical portion which extends from the user's forehead, over the crown of the head to the back of the head; the vertical portion also includes apertures for insertion of protective inserts. The inserts are either foam-like or polymeric, and function to absorb and dissipate impact forces with which the user's head comes in contact.

The object of the present invention is to have a headband of uniform thickness so that a player can maintain better control of headshots. A further object of the present invention is to have a headband that is continuous and therefore protects the head from impact by the ball on all sides, and not just the forehead. A further object of the present invention is that the layers be permanently affixed so that they cannot be voluntarily or inadvertently separated. A further object of the present invention is to construct the outer layer of a hard, elastic material, such as leather or rubber, so that it absorbs more impact than a soft padding device would, permitting rebound speed off the forehead to be maintained without the player intentionally increasing the force of impact to compensate. A further object of the present invention is that that the headband be lightweight, unobtrusive, and custom imprintable, so that it is esthetically acceptable to young wearers.

SUMMARY OF THE INVENTION

A headband that reduces the force of impact to be worn about the head of a sports player to protect against injury is provided. The headband, which is made of layers permanently affixed to each other, is of uniform thickness so that a player can maintain better control of headshots, is continuous, and therefore protects the head from impact by the ball on all sides, and is lightweight, unobrusive and custom imprintable so that it is aesthetically acceptable to young wearers.

According to one embodiment of the invention, a headband to be worn about the head of a sports player to protect against injury comprises an outer layer, an inner layer, and means for holding the headband about the player's head, wherein the outer layer and inner layer are adhesively connected to each other, and wherein the headband is of uniform vertical height and thickness along its entire length. In another embodiment, the means for holding the headband about the player's head of such a headband comprises releasably attachable ends. In another embodiment, the means for holding the headband about the player's head comprises an intermediate layer between the outer layer and inner layer, wherein the intermediate layer comprises elastic. In another embodiment, such a headband is manufactured in a variety of sizes. In another embodiment, such a headband is utilized by a soccer player.

In another embodiment, the outer layer of a headband to be worn about the head of a sports player to protect against injury comprising an outer layer, an inner layer, and means for holding the headband about the player's head, wherein the outer layer and inner layer are adhesively connected to each other, and wherein the headband is of uniform vertical height and thickness along its entire length, is constructed of a hard elastic material selected from the group consisting of rubber and leather, wherein the outer layer presents a smooth, continuous surface along its entire length, and the inner layer of such a headband is comprised of a material comprising cotton, rubber, nylon, a coolant and elastic. In another embodiment, the means of such a headband comprises releasably attachable ends. In another embodiment, the means of such a headband comprises an intermediate layer comprising elastic. In another embodiment, such a headband is manufactured in a variety of sizes. In another embodiment, such a headband is utilized by a soccer player.

In another embodiment, a headband to be worn about the head of a sports player to protect against injury comprises an outer layer, wherein the outer layer is constructed of a hard elastic material selected from the group consisting of rubber and leather, wherein the outer layer presents a smooth, continuous surface along its entire length, a first intermediate layer comprising a coolant, and an inner layer composed of a material comprising cotton, rubber, nylon, and elastic, and means for attaching the ends of the headband for placement about the player's head, wherein the outer layer, first intermediate layer, and inner layer are adhesively connected to each other, and wherein the headband is of uniform vertical height and thickness along its entire length. In another embodiment, the means of such a headband comprises releasably attachable ends. In another embodiment, the means of such a headband comprises a second intermediate layer, wherein the second intermediate layer comprises elastic and is adhesively connected to the outer layer, first intermediate layer and inner layer. In another embodiment, such a headband is manufactured in a variety of sizes. In another embodiment, such a headband is utilized by a soccer player.

In another embodiment, a headband to be worn about the head of a sports player to protect against injury comprises an outer layer, wherein the outer layer is constructed of a hard elastic material selected from the group consisting of rubber and leather, wherein the outer layer presents a smooth, continuous surface along its entire length, an intermediate layer comprising elastic, and an inner layer composed of a material comprising cotton, rubber, nylon, and elastic, wherein the ends of the headband are secured to each other to each other to form a continuous loop for placement about the player's head, wherein the outer layer, intermediate layer, and inner layer are adhesively connected to each other, and wherein the headband is of uniform vertical height and thickness along its entire length. In another embodiment, such a headband is manufactured in a variety of sizes. In another embodiment, such a headband is utilized by a soccer player.

In another embodiment, a method for providing a protective device that protects the head of a sports player and conforms to a player's head comprises the steps of: sizing a length of elastic to conform comfortably to a player's head, wherein the elastic consists of an inner surface and an outer surface; securing the ends of the elastic to each other to form a continuous loop; preparing first polygonal shapes constructed of a hard elastic material selected from the group consisting of rubber and leather, wherein the polygonal shapes are of uniform vertical height and thickness; adhesively aligning the polygonal shapes along the outer surface of the elastic such that each lateral edge of each of the shapes touches the next polygonal shape when the elastic is in an unexpanded state; expanding the elastic to the size of a player's head to reveal a space between the lateral sides of each adjacent first polygonal shape on the outer surface; preparing second polygonal shapes constructed of a hard elastic material selected from the group consisting of rubber and leather, wherein each second polygonal shape is sized to fit perfectly between the spaces between the lateral sides of each adjacent first polygonal shape on the outer surface, wherein the second polygonal shapes are of the same uniform vertical height and thickness as the first polygonal shapes; adhesively applying the second polygonal shapes to the elastic in each space between the lateral sides of each adjacent first polygonal shapes between the first polygonal shapes such that the outer surface is a smooth, continuous surface; adhesively applying a material comprising cotton, rubber, nylon, and elastic to the inner surface; and securing the headband about the player's head.

DETAILED DESCRIPTION OF THE PREFERRED EMBODIMENTS

The present invention is described by way of example and in regard to the drawings. The figure briefly described above are discussed in detail below.

Figure 1:
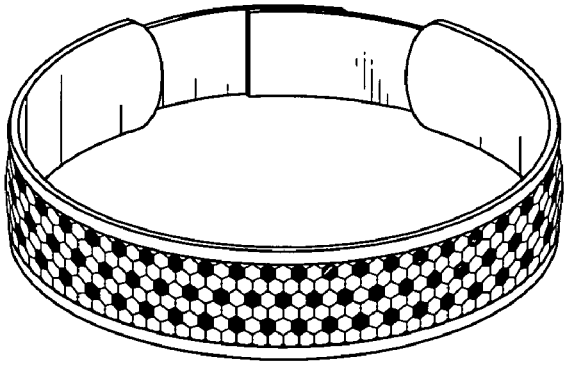
FIG. 1 is a front perspective view of a headband of the present invention wherein the ends are releasably attachable.
Figure 2:
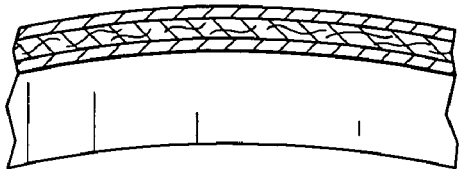
FIG. 2 is an inside view of the inside of the headband of FIG. 1.

FIG. 1 is a front perspective view of the protective headband of the invention. The illustrated headband comprises two layers or surfaces. The surface of the headband which comes into contact with the player's head is the inner surface or inner layer. As shown in FIG. 2, the inner layer is made of a soft cushioned material and is cushioned to absorb impacts. In a preferred embodiment, this material is comprised of cotton, rubber, nylon, and elastic. In the most preferred embodiment, this material is comprised of about 70% cotton, about 5% rubber, about 5% nylon, about 10% elastic and incorporates at about 10% a material or substance that removes or prevents perspiration from running onto the player's face, e.g., a coolant.

Figure 3:
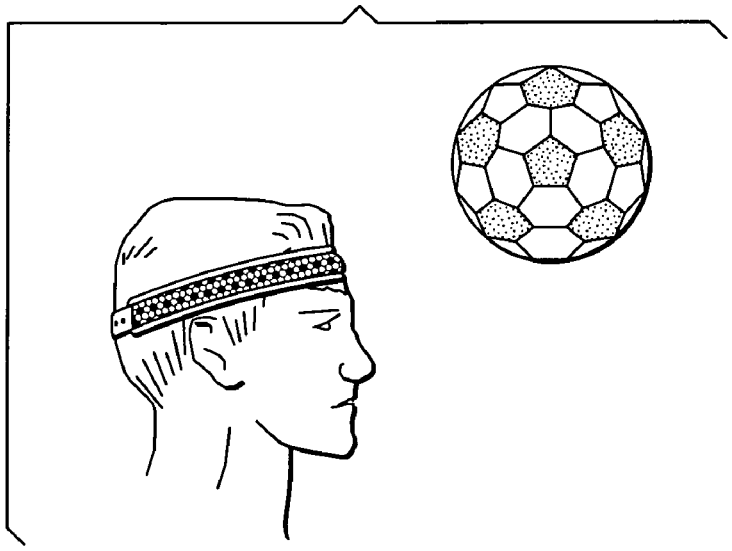
FIG. 3 is a perspective view of one embodiment of the headband of the present invention being worn by a person about the head.

The surface that comes into contact with the ball is the outer surface or outer layer. The outer layer is made of a hard elastic material, such as leather or rubber and presents a smooth, continuous surface to the ball along its entire length. Part of the outer layer can be custom imprinted with a team logo by methods known in the art. While the imprint is shown affixed to the front of the headband, it could be located anywhere that is practically possible and commercially advantageous. FIG. 3 is a perspective view of one embodiment of a protective device of the present invention being worn by a person about the head.

In an alternative embodiment, a separate intermediate layer comprising a coolant may be inserted between the inner layer and outer layer.

The layers are adhesively connected or otherwise fused to each other so that they cannot be purposefully separated by ordinary means.

In general, the circumference of the headband of the invention for an adult measures about 23 inches end to end. The vertical height is about 2 inches and the thickness of a headband comprised of an inner and outer layer is about half inch. One of ordinary skill in the art would appreciate that a headband of the invention made for children and youths will be sized smaller than a headband for an adult.

The headband is made adjustable by the inclusion of releasable fastening means, such as the plastic fasteners shown in FIG. 1, which can be positioned to engage each other to releasably attach the ends together to form a continuous loop when the headband is placed about a player's head. In an alternative embodiment, the headband is sized to fit a range of head sizes, including size ranges for children and for teens which will be smaller than sizes for adults.

Figure 4:
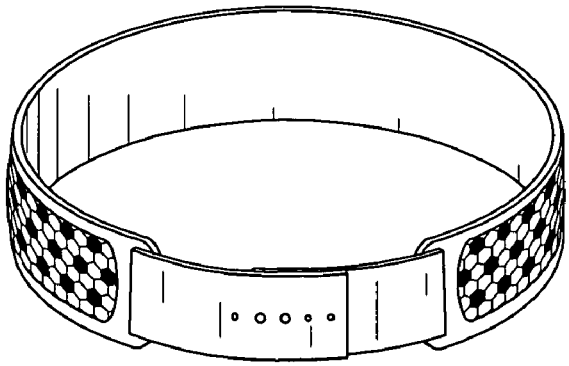
FIG. 4 is a back perspective view of a headband of the present invention, wherein the ends of the headband are secured to each other to form a continuous loop for placement about a player's head.
Figure 5:
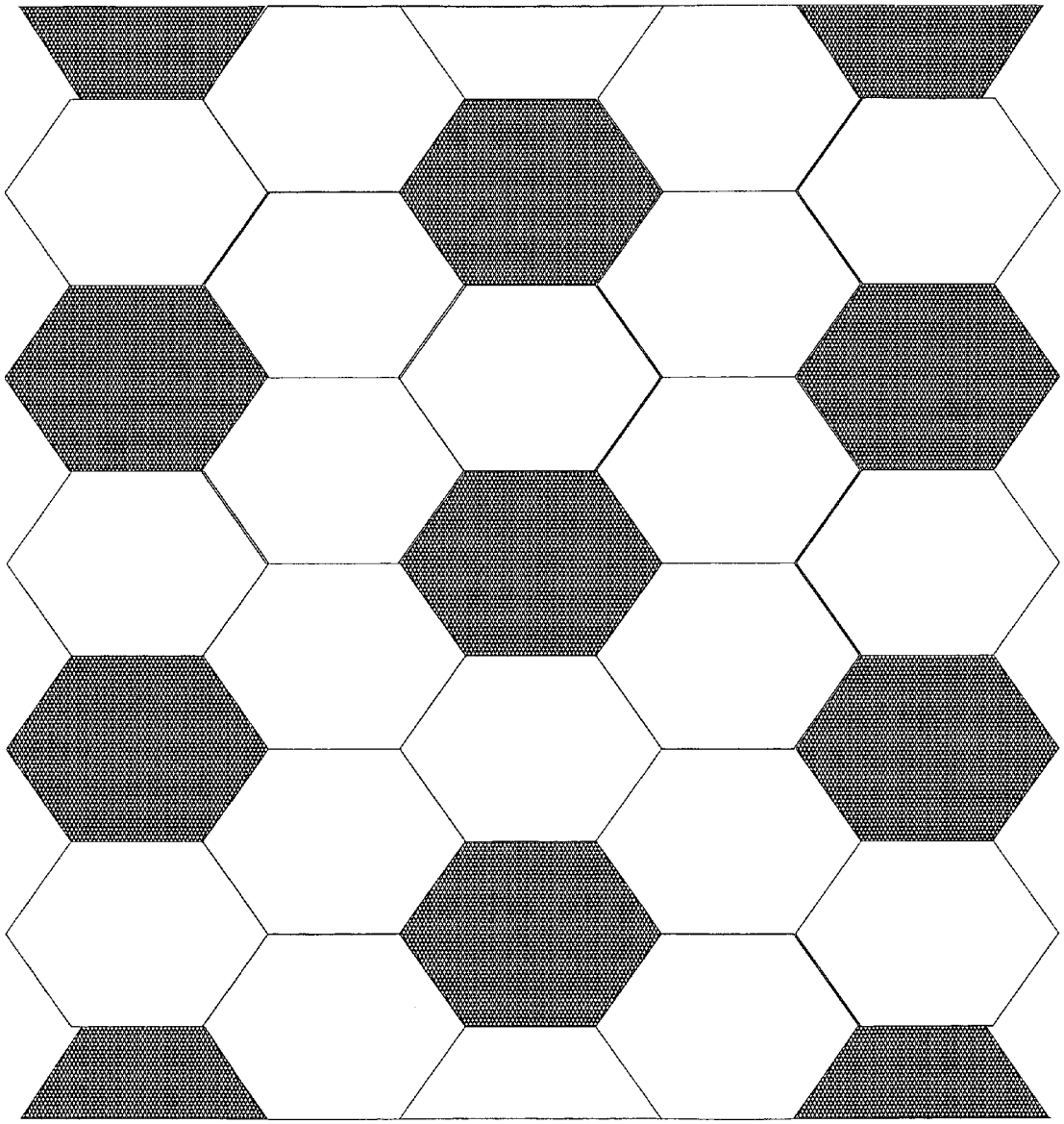
FIG. 5 illustrates an exploded view of an exemplary arrangement of the first and second polygonal shapes of the outer layer of the headband, according to an embodiment of the present invention.

In an alternate embodiment, an additional intermediate layer of elastic is incorporated between the inner and outer layers to make a headband that conforms to a player's head without necessitating a fastening means. In one such an embodiment, the outer layer is comprised of separate polygonally shaped pieces of leather or rubber to allow the headband to expand to fit the player's head. When the headband so expands, the elastic layer initially will be visible between these pieces. Upon determining the final required size of the headband, leather or rubber inserts sized to correspond exactly to the areas of elastic that are exposed are inserted between the existing polygonally shaped pieces and adhesively applied so that the outer surface remains a smooth, continuous surface with no dead zones that would dampen the impact energy of the soccer ball. In a preferred embodiment, shown in FIG. 5, alternating polygonally-shaped pieces of leather or rubber and inserts gives the headband an appearance similar to the appearance of a soccer ball (FIG. 4). The present invention also provides a pack or kit comprising one or more of the components of the invention.

Where a range of values is provided herein, it is understood that each intervening value, to the tenth of the unit of the lower limit unless the context clearly dictates otherwise, between the upper and lower limit of that range and any other stated or intervening value in that stated range is encompassed within the invention. The upper and lower limits of these smaller ranges which may independently be included in the smaller ranges is also encompassed within the invention, subject to any specifically excluded limit in the stated range. Where the stated range includes one or both of the limits, ranges excluding either both of those included limits are also included in the invention.

Unless defined otherwise, all technical terms used herein have the same meaning as commonly understood by one of ordinary skill in the art to which this invention belongs. Although any methods and materials similar or equivalent to those described herein can also be used in the practice or testing of the present invention, the preferred methods and materials are now described. All publications mentioned herein are incorporated herein by reference to disclose and describe the methods and/or materials in connection with which the publications are cited.

It must be noted that as used herein and in the appended claims, the singular forms "a", "and", and "the" include plural referents unless the context clearly dictates otherwise. All technical terms used herein have the same meaning.

The publications discussed herein are provided solely for their disclosure prior to the filing date of the present application. Nothing herein is to be construed as an admission that the present invention is not entitled to antedate such publication by virtue of prior invention. Further, the dates of publication provided may be different from the actual publication dates which may need to be independently confirmed.

The invention is not limited to the sport of soccer and can be used wherever a subject in need thereof is subject to impact injuries to the head. The designs described herein are merely examples and do not limit the invention. It should be understood by those skilled in the art that various changes may be made and equivalents may be substituted without departing from the true spirit and scope of the Invention. In addition, many modifications may be made to adapt a particular situation, material, composition of matter, process, process step or steps, to the objective, spirit and scope of the present invention. All such modifications are intended to be within the scope of the claims appended hereto.

What is claimed is:

1. A method for providing a protective device that protects the head of a sports player and conforms to a player's head comprising the steps of:

a. sizing a length of elastic to conform comfortably to a player's head, wherein the elastic consists of an inner surface and an outer surface;

b. securing the ends of the elastic to each other to form a continuous loop;

c. preparing first polygonal shapes constructed of a hard elastic material selected from the group consisting of rubber and leather, wherein the polygonal shapes are of uniform vertical height and thickness;

d. adhesively aligning the polygonal shapes along the outer surface of the elastic such that each lateral edge of each of the shapes touches the next polygonal shape when the elastic is in an unexpanded state;

e. expanding the elastic to the size of a player's head to reveal a space between the lateral sides of each adjacent first polygonal shape on the outer surface;

f. preparing second polygonal shapes constructed of a hard elastic material selected from the group consisting of rubber and leather, wherein each second polygonal shape is sized to fit perfectly between the spaces between the lateral sides of each adjacent first polygonal shape on the outer surface, wherein the second polygonal shapes are of the same uniform vertical height and thickness as the first polygonal shapes;

g. adhesively applying the second polygonal shapes to the elastic in each space between the lateral sides of each adjacent first polygonal shapes between the first polygonal shapes such that the outer surface is a smooth, continuous surface;

h. adhesively applying a material comprising cotton, rubber, nylon, and elastic to the inner surface; and i. securing the headband about the player's head.

2. A protective device that protects the head of a sports player and conforms to a player's head comprising:

a. a length of elastic sized to conform comfortably to a player's head, wherein the elastic consists of an inner surface and an outer surface;

b. a first end and a second end of the elastic wherein the first end and the second end are secured to each other to form a continuous loop;

c. first polygonal shapes constructed of a hard elastic material selected from the group consisting of rubber and leather, wherein the first polygonal shapes are of uniform vertical height and thickness;

d. second polygonal shapes constructed of a hard elastic material selected from the group consisting of rubber and leather wherein the second polygonal shapes are of the same uniform vertical height and thickness as the first polygonal shapes;

wherein the first polygonal shapes and the second polygonal shapes are adhesively aligned along the outer surface of the elastic to form a covered outer surface, such that the covered outer surface is a smooth, continuous surface; and e. a material comprising cotton, rubber, nylon, and elastic adhesively applied to the inner surface of the elastic.

3. The protective device according to claim 2, wherein the device is utilized by a soccer player.

4. The protective device according to claim 2, wherein the first end of the elastic and the second end of the elastic are secured to each other by releasably attachable ends.

5. A soccer package comprising (i) a protective device that protects the head of a sports player and conforms to a player's head comprising:

a. a length of elastic sized to conform comfortably to a player's head, wherein the elastic consists of an inner surface and an outer surface;

b. a first end and a second end of the elastic wherein the first end and the second end are secured to each other to form a continuous loop;

c. first polygonal shapes constructed of a hard elastic material selected from the group consisting of rubber and leather, wherein the polygonal shapes are of uniform vertical height and thickness;

d. second polygonal shapes constructed of a hard elastic material selected from the group consisting of rubber and leather wherein the second polygonal shapes are of the same uniform vertical height and thickness as the first polygonal shapes;

wherein the first polygonal shapes and the second polygonal shapes are adhesively aligned along the outer surface of the elastic to form a covered outer surface, such that the covered outer surface is a smooth, continuous surface; and e. a material comprising cotton, rubber, nylon, and elastic adhesively applied to the inner surface of the elastic; and (ii) a soccer ball.

* * * * *